US006153052A

United States Patent [19]

Luthe et al.

[11] Patent Number: 6,153,052

[45] Date of Patent: Nov. 28, 2000

[54] PULPING PROCESS

[75] Inventors: Corinne Elizabeth Luthe, Ile Cadieux; Richard McKinnon Berry, Ile Perrot, both of Canada; Jian Li, Marietta, Ga.

[73] Assignee: Pulp and Paper Research Institute of Canada, Pointe Claire, Canada

[21] Appl. No.: 09/397,074

[22] Filed: Sep. 16, 1999

Related U.S. Application Data

[60] Provisional application No. 60/103,640, Oct. 9, 1998.

[51] Int. Cl.[7] ..... D21C 3/02

[52] U.S. Cl. ..... 162/65; 162/68; 162/82

[58] Field of Search ..... 162/65, 82, 68, 162/19

[56] References Cited

U.S. PATENT DOCUMENTS

| | | | |
|---|---|---|---|
| 3,215,588 | 11/1965 | Kleinert | 162/19 |
| 3,664,918 | 5/1972 | Clayton et al. | 162/82 |
| 3,664,919 | 5/1972 | Clayton et al. | 162/82 |
| 3,704,201 | 11/1972 | Helasti | 162/19 |
| 4,012,280 | 3/1977 | Holton . | |
| 4,024,229 | 5/1977 | Smith et al. . | |
| 5,082,526 | 1/1992 | Dorris . | |

OTHER PUBLICATIONS

Carboxyl End Groups in Sulfate and Polysulfide Pulps, Bo Alfredsson et al, Department of Engineering Chemistry, Chalmers Tekniska Hogskola, Goteborg, Sweden, Nr. 18, Sep. 30, 1963, pp. 703–706.

Sulphate Cooking with the Addition of Reducing Agents, Part 1, Preliminary report on the addition of sodium borohydride, N. Hartler, The Central Laboratory of the Swedish Cellulose Industry, Stockholm, Sweden, Nr. 13, Jul. 15, 1959, pp. 467–470.

Hemicelluloses and Paper Properties of Brich Pulps, Part 3, Sune E. Pettersson et al, Scensk Papperstidning drg. pp. 4–17.

Multi–Stage Polysulphide Pulping Process, Part I, Basic Ideas and Low–Temperature Impregnation Studies on Black Spruce Heartwood, Clayton et al, Pulp and Paper Research Institute of Canada, Dec. 1967, pp. T–619–630.

Cooking Liquor Oxidation and Improved Cooking Technique in Polysulfide Pulping, Landmark et al, vol. 48, No. 5, May 1965, Tappi, pp. 56A–58A.

Factors Affecting Yield Increase and Fiber Quality in Polysulfide Pulping of Loblolly Pine, other Softwoods and Red Oak, vol. 47, No. 10, Oct. 1964, Tappi, pp. 640–652, Sanyer et al.

Some Aspects of the Chemistry of Polysulfide Pulping, Ants Teder, Svensk Papperstidning drg. 72, No. 9, May 15, 1969.

Polarographic Analysis of Soda–Anthraquinone Pulping Liquor, Fleming et al, Tappi, Jul. 1979, vol. 62, No. 7, pp. 55–58.

The Thermal Decomposition of Aqueous Polysulfide solutions, Gustafsson et al, Swedish Forest Products Research Laboratory, Stockholm, Sweden, Nr. 8, Apr. 30, 1969, pp. 249–260.

*Primary Examiner*—Steve Alvo
*Attorney, Agent, or Firm*—Swabey Ogilvy Renault

[57] ABSTRACT

An improved pulping process by which pulp yield is increased requires using polysulfide in the cooking liquor and lignocellulosic particles having a maximum thickness of 2 mm.

20 Claims, 1 Drawing Sheet

PULPING PROCESS

This application claims benefit to Provisional Application 60/103,640, Oct. 9, 1998.

BACKGROUND OF THE INVENTION

1. Field of the Invention

The present invention relates to an improved pulping process to increase pulp yield, and more particularly it relates to the utilization of wood particles having a maximum thickness of 2 mm and polysulfide in the cooking liquor.

2. Description of the Prior Art

In kraft pulping operations, where the goal is to remove lignin while retaining carbohydrates, yield is increased by minimizing carbohydrate (i.e., cellulose and hemicellulose) degradation. Degradation occurs through a "peeling" reaction in which sugar units are sequentially removed from the reducing end group of the polysaccharide chains. One way to prevent this reaction is to convert aldehyde groups on the wood polysaccharides to a form which is relatively inert to further "peeling." This conversion is achieved by either oxidizing the aldehyde to its corresponding carboxylic acid Alfredsson, B., Samuelson, O. and Sandstig, B. Carboxyl end groups in sulfate and polysulfide pulps. Svensk Papperstidn. 66(18):703 (1963) and U.S. Pat. No. 4,012,280, Holton) or, alternatively, reducing it to its alcohol form (Hartler, N. Sulphate cooking with the addition of reducing agents. Part 1. Preliminary report on the addition of sodium borohydride. Svensk Papperstidn. 62(13):467 (1959) and Pettersson, S. E. and Rydholm, S. A. Hemicelluloses and paper properties of birch pulps. Part 3. Svensk Papperstidn. 64(1):4 (1961)). The two methods that are currently employed involve an oxidation process and use anthraquinone (U.S. Pat. No. 4,012,280), or polysulfide (Clayton, D. W. and Sakai, A. Multi-stage polysulfide pulping processes. Part I). Basic ideas and low-temperature impregnation studies on black spruce heartwood. Pulp Pap. Mag. Can. 68(12):619 (1967); Landmark, P. A., Kleppe, P. J. and Johnsen, K. Cooking liquor oxidation and improved cooking technique in polysulfide pulping. Tappi J. 48(5):56 (1965); Sanyer, N. and Laundrie, J. F. Factors affecting yield increase and fiber quality in polysulfide pulping of loblolly pine, other softwoods, and red oak. Tappi J. 47(10):640 (1964); and Teder, A. Some aspects of the chemistry of polysulfide pulping. Svensk Papperstidn. 72(9):294 (1969)), or both as the oxidizing agents. Anthraquinone is a catalytic additive while polysulfide is generated from white liquor by oxidation of sodium sulfide in one of several processes (U.S. Pat. Nos. 5,082,526, Dorris; and 4,024,229, Smith et al). Of the two yield enhancing agents, anthraquinone is the more stable and can be used at the highest temperatures applied during the pulping process (Fleming, B. I., Kubes, G. J., MacLeod, J. M. and Bolker, H. I. Polarographic analysis of soda-anthraquinone pulping liquor. Tappi J. 62(7):55 (1979)). In contrast, it is known that polysulfide and carbohydrates react at an appreciable rate only at temperatures above 110° C. (Clayton et al., above), while the competing reaction, decomposition of polysulfide to sulfide and thiosulfate, becomes very rapid above 130° C. (Clayton et al., 1967, above and Gustafsson, L. and Teder, A. The thermal decomposition of aqueous polysulfide solutions. Svensk Papperstidn. 72(8):249 (1969)).

The reactions of the yield enhancing agents with the sugar components involve a liquid-solid phase interaction. The reagent ions have to penetrate the wood chips before they can react with the polysaccharides. Anthraquinone, because of its temperature stability, has sufficient time during the progression of cooking to penetrate into the wood chips. In contrast, polysulfide has, to a first approximation, only the time that the temperature remains below 130° C. to penetrate into the wood chips. For this reason, polysulfide effectiveness is generally improved by impregnating wood chips with polysulfide liquor at temperatures below 100° C., and then having a polysulfide treatment period of 15 to 30 minutes, at temperatures between 110 and 130° C. This procedure delays application of the higher cooking temperatures that lead to very fast polysulfide decomposition.

In contrast to conventional kraft cooking, sawdust pulping in M&D (Messing & Durkee) digesters, for example, involves a very rapid rise to temperature, typically less than 5 minutes to 185° C. This time to temperature is too short to provide sufficient time at temperatures between 110 and 130° C. to permit the polysulfide to react effectively and efficiently with the carbohydrates.

This assumption has also governed the operation of conventional systems digesters which incorporate time for impregnation, a slow rise to temperature and chip thickness screening which targets chip accepts, for example, between 2 and 8 mm for softwood kraft pulping.

SUMMARY OF THE INVENTION

An object of the present invention is to increase the pulp yield of wood furnishes by providing an improved cooking process which includes rapidly bringing the furnish to cooking temperature during the cooking procedure.

A second object of the present invention is to simplify and shorten the conventional kraft cooking process using polysulfide in the cooking liquor.

The present invention provides an improved pulping process wherein a wood furnish having a particle thickness of not more than 2 mm is cooked in a kraft cooking liquor containing polysulfide anions.

In accordance with one aspect of the invention there is provided a process of cooking particulate lignocellulosic material in a cooking liquor to reduce kappa number and produce wood pulp, comprising: cooking particulate lignocellulosic material having a particle thickness of not more than 2 mm in a kraft cooking liquor having an effective content of polysulfide.

In another aspect of the invention there is provided in a wood particle digestion process in which wood particles are cooked in a kraft cooking liquor to reduce kappa and produce pulp, while oxidizing aldehyde groups in the wood polysaccharides of the wood particles, with polysulfide in the cooking liquor, the improvement wherein the wood particles have a thickness of up to 2 mm.

DETAILED DESCRIPTION OF THE INVENTION

In the method of this invention, improved polysulfide impregnation into the fibre walls and to the reaction sites of lignocellulosic material is achieved by cooking lignocellulosic material comprising particles whose thickness is not more than 2 mm. Examples of such materials are wood chips, for example, thin wood chips, pin wood chips, wood fines, sawdust and partially delignified pulp fibre. Using this method, pre-impregnation of the lignocellulosic material with the polysulfide liquor is not required. More importantly and unexpectedly, the temperature of the polysulfide cook does not need to be restricted to cooking temperatures of between 110 to 130° C. Once the lignocellulosic material is mixed with the polysulfide cooking liquor, the temperature can be raised in excess of 150° C. within a very short time, for example, 2 to 10 minutes. This rapid temperature-increase is a normal strategy when using industrial M&D digesters which are typically used for sawdust pulping using the kraft process. Employing polysulfide according to the method of the invention promotes rapid diffusion throughout a wood furnish having a particle thickness of not more than 2 mm and the polysulfide reacts rapidly with the reducing end groups of the carbohydrate chain. This rate of diffusion is greater than the rate of the polysulfide decomposition reactions even when the temperature is raised quickly to over 150° C.

Typically this rapid cooking is achieved employing polysulfide in the cooking liquor in an amount of about 1 to about 2%, by weight, expressed as elemental sulfur, based on the weight of lignocellulosic material and heating the cooking liquor containing the lignocellulosic material having a particle thickness of not more than 2 mm, to a cooking temperature of at least 150° C., preferably about 165 to about 185° C., in a time of about 2 to about 10, preferably about 2 to about 5 minutes.

In a particular embodiment employing sawdust as the lignocellulosic material the pulp yield was increased by 2.3 to 2.5%, by weight (based on oven dry lignocellulosic material) over a kappa number range of 20 to 30, employing a 1.6%, by weight, (based on the weight of lignocellulosic material) polysulfide charge in the cooking liquor.

The method of the invention may also be applied in a conventional slow cook with improved pulp yield. In this case the cooking liquor containing the lignocellulosic material having a particle thickness of not more than 2 mm, and the polysulfide, is typically heated slowly to a cooking temperature of about 150° C. to about 175° C. in a time of about 85 to about 95 minutes; the polysulfide charge being about 1 to 2%, by weight, as described for the rapid cooking embodiment.

A particular advantage of the invention is that the simpler preparation and digestion technology employed for sawdust cooking can be used for cooking wood chips provided the particle thickness is not more than 2 mm, and that polysulfide is employed in the cooking liquor.

Modified cooking processes where liquors are added at different times during the cooking process may also be improved by the method of the invention. Particularly if thin chips are used, polysulfide liquor can be added into high temperature cooking zones and be effective despite the rapid rise to temperature that the liquor would experience.

Reference to the "thickness" of the particles of lignocellulosic material or wood chips herein, is to be understood as the dimension of the particles generally perpendicular to the fibre axes of the fibres of the particle, which fibre axes are generally aligned and generally parallel.

Reference herein to the lignocellulosic material having a particle thickness of not more than 2 mm is to be understood as material in which at least 90%, preferably at least 95% and more preferably at least 98%, by weight, is of particles having a thickness of not more than 2 mm.

As employed herein an "effective content" of polysulfide contemplates an amount effective to oxidize aldehyde groups in the wood polysaccharides of the particles of lignocellulosic material, thereby hindering carbohydrate degradation in the lignocellulosic material during cooking.

EXAMPLES

Example 1

Figure 1:
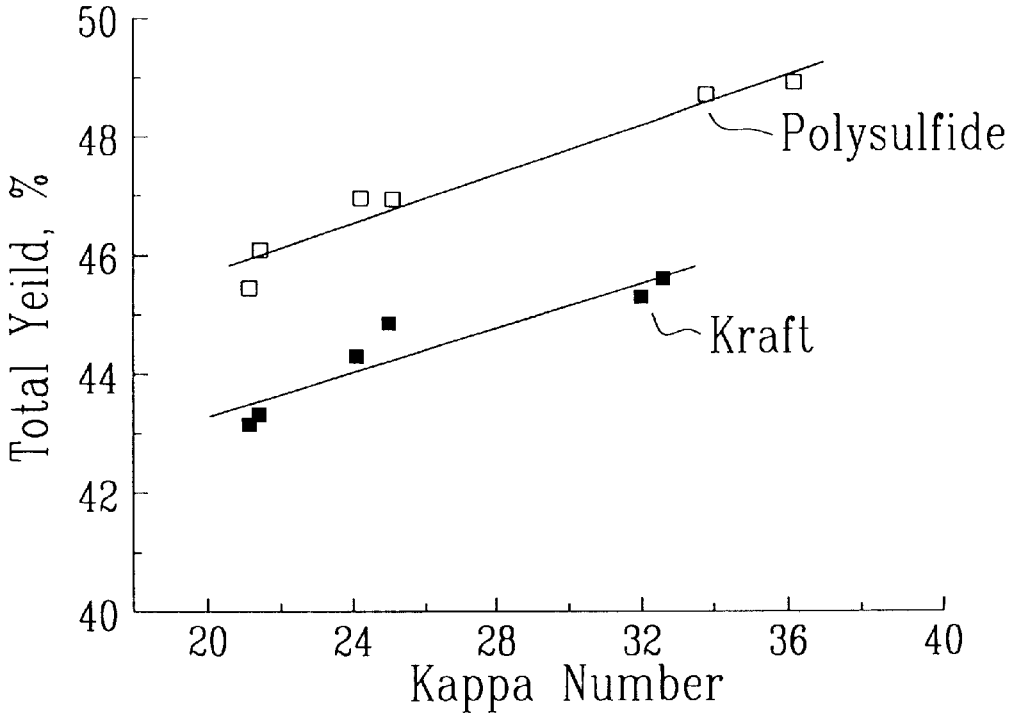
FIG. 1 is a plot of total yield against kappa number of sawdust cooking with an M & D temperature profile employing a kraft cooking liquor with and without polysulfide.

This Example illustrates the increase in pulp yield that is achievable using polysulfide in the cooking liquor, wood particles having a maximum thickness of 2 mm and, a rapid rise to cooking temperature.

A debarked log of black spruce was hand cut into two batches of wood chips having exactly the same length and width but different thickness. One batch was made up with chips of 2 mm thickness and the second was made up with chips of 4 mm thickness. Both batches were cooked with and without polysulfide in the cooking under the following conditions.

| | |
|---|---|
| Active alkali: | 18% on wood charge (on oven dried wood) |
| Liquor Sulfidity: | 30% for kraft; 15% for polysulfide-kraft liquors |
| Polysulfide: | 1.6% on wood |
| Liquor-to-wood ratio: | 4.5:1 (including wood moisture) |
| Cooking temperature: | 165° C. |

Cooking was carried out in pressurized digesters (2-L volume) charged with 100 g/o.d. (40% solids) and an appropriate volume of cooking liquor to bring the liquor to wood ratio to 4.5:1. The digesters were sealed and transferred to an oil bath which had been preheated to 175° C. This cooking temperature of 165° C. was reached in 5 minutes. When the predetermined H-factor was reached, the digesters were removed from the oil bath and cooled to room temperature in cold water.

The cooked pulp was transferred to a container of water (6 L) and disintegrated for 3 minutes. The disintegrated pulp was thoroughly washed and soaked in water (5 L) for 18 hours prior to screening.

In the polysulfide-kraft cook the sulfidity of the cooking liquor was reduced by 50%, with the other half of the sulfur charge being present as the polysulfide ion. The resulting polysulfide charge on wood was 1.6% expressed as elemental sulfur. The total sulfur charge in the kraft and the polysulfide-kraft liquors was equivalent.

The results in Table I indicate that by using wood particles having a thickness of 2 mm polysulfide is completely effective and the yield of the cooked furnish was increased by 1.3% over a range of kappa numbers. The results also indicate that, although the yield from the conventional kraft cook, employing wood chips of 2 mm thickness, decreased by 0.5 to 1.0%, surprisingly, the yield from the polysulfide-kraft cook increased by 0.3 to 0.8%.

TABLE I

| Process | Chip thickness, mm | Kappa number | Yield, % | Yield improvement by adding polysulfide, % |
|---|---|---|---|---|
| Kraft | 4 | 30 | 48.7 | |
| Polysulfide-kraft | 4 | 30 | 48.7 | 0.0 |
| Kraft | 4 | 20 | 47.2 | |
| Polysulfide-kraft | 4 | 20 | 47.2 | 0.0 |

TABLE I-continued

| Process | Chip thickness, mm | Kappa number | Yield, % | Yield improvement by adding polysulfide, % |
|---|---|---|---|---|
| Kraft | 2 | 30 | 48.2 | |
| Polysulfide-kraft | 2 | 30 | 49.5 | 1.3 |
| Kraft | 2 | 20 | 46.2 | |
| Polysulfide-kraft | 2 | 20 | 47.5 | 1.3 |

Example 2

This Example illustrates the increase in kraft pulp yield that is achievable when a more finely divided wood particle furnish (sawdust) is used under conditions where a very rapid rise to cooking temperature is applied as in Example 1.

The results shown in Table II indicate that by changing the wood furnish from 4 mm chips to sawdust and consequently decreasing the wood particle thickness, polysulfide becomes effective and increases the yield of the furnish by 2.1 to 2.2% over a range of kappa numbers. Once again the results show that although decreasing the wood particle thickness decreases the yield from the conventional kraft process by between 1.5 and 2.0%, it again, surprisingly, increases the yield from the polysulfide kraft process by between 0.1 and 0.7%.

TABLE II

| Process | Furnish | Kappa number | Yield, % | Yield improvement by adding polysulfide, % |
|---|---|---|---|---|
| Kraft | 4 mm chips | 30 | 48.7 | |
| Polysulfide-kraft | 4 mm chips | 30 | 48.7 | 0.0 |
| Kraft | 4 mm chips | 20 | 47.2 | |
| Polysulfide-kraft | 4 mm chips | 20 | 47.2 | 0.0 |
| Kraft | Sawdust | 30 | 47.2 | |
| Polysulfide-kraft | Sawdust | 30 | 49.4 | 2.2 |
| Kraft | Sawdust | 20 | 45.2 | |
| Polysulfide-kraft | Sawdust | 20 | 47.3 | 2.1 |

Example 3

This example shows that changing the furnish species from that of Example 2, and increasing the cooking temperature does not change the benefit from decreasing the wood particle thickness that can be obtained under conditions where a very rapid rise to cooking temperature is used.

In this example the experimental procedure of Example 1 was followed using a western coastal sawdust furnish which was cooked with and without polysulfide under the following conditions.

| | |
|---|---|
| Active alkali: | 20% on wood charge (on oven dried wood) |
| Liquor Sulfidity: | 30% for kraft, 15% for polysulfide-kraft liquors |
| Polysulfide: | 1.6% on wood |
| Liquor to wood ratio: | 3.6:1 (including wood moisture) |
| Cooking temperature: | 185° C. |

Despite the different furnish and the higher cooking temperature, polysulfide gave a yield improvement over conventional kraft of between 2.3% and 2.7% on o.d. wood. This is demonstrated clearly in FIG. 1.

Example 4

This example illustrates that changing the furnish, the active alkali (17.0 to 21.5%), sulfidity (30.0 to 38.0%), and polysulfide charge (1.6 to 1.8%) does not change the benefit derived from decreasing the wood particle thickness under cooking conditions where a very rapid rise to temperature is used. The pulping experiments were carried out as described in Example 1. The chemical charges used and associated yield benefits relative to the kraft process are shown in Table III. The sawdust furnishes used in this example are coastal B.C. species mixture (Furnish 1), and interior B.C. species mixture (Furnishes 2 and 3).

For all three furnishes the relative yield benefits at 30 kappa ranged from 2.3 to 3.5% and from 2.3 to 2.7% at 20 kappa.

TABLE III

| Furnish No. | 1 | 2 | 3 |
|---|---|---|---|
| L:W (o.d.) Ratio* | 3.6:1 | 3.5:1 | 3.5:1 |
| AA, % (on o.d. wood) | 20.0 | 21.5 | 17.0 |
| Sulfidity, % (Kraft)** | 30.0 | 33.0 | 38.0 |
| Sulfidity, % (PS)** | 15.0 | 16.0 | 19.0 |
| PS, % (on o.d. wood) | 1.6 | 1.8 | 1.7 |
| Yield benefit, %*** | 2.7 | 3.5 | 2.3 |
| Yield benefit, %**** | 2.3 | 2.7 | 2.6 |

*this ratio includes the moisture in the wood
**sulfidity is expressed on an AA basis
***at 30 kappa number
**** at 20 kappa number
AA = active alkali
PS = polysulfide
L:W = Liquor to wood ratio Example 5

Figure 2:
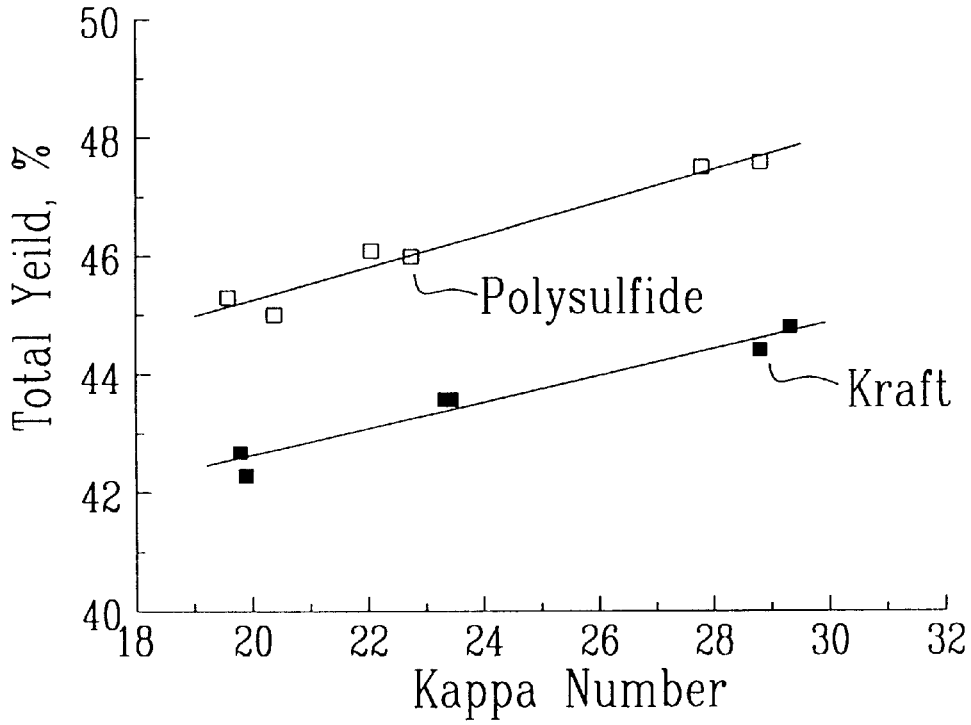
FIG. 2 is a plot of total yield against kappa number for sawdust cooking with a conventional cooking temperature profile employing a kraft cooking liquor with and without polysulfide.

This example illustrates that good yield increases can also be obtained with furnishes in which the wood particle thickness is less than 2 mm (sawdust) under conditions simulating conventional cooking. The pulping experiments were carried out as described in Example 1, but using a time to temperature profile of conventional cooking, i.e., a 90 minute time to temperature (170° C.). The chemical charges used and relative yield benefits are shown in Table IV. The yield benefits at 30 kappa ranged from 2.8 to 3.1%; at 20 kappa they ranged from 1.9 to 2.6%. For Furnish No. 4 the yield benefit is demonstrated clearly in FIG. 2.

TABLE IV

| Furnish No. | 1 | 4 |
|---|---|---|
| L:W (o.d.) Ratio* | 3.6:1 | 4.7:1 |
| AA, % (on o.d. wood) | 20.0 | 21.0 |
| Sulfidity, % (Kraft)** | 30.0 | 24.5 |
| Sulfidity, % (PS)** | 15.0 | 12.3 |
| PS, % (on o.d. wood) | 1.6 | 1.3 |
| Yield benefit, %*** | 3.1 | 2.8 |
| Yield benefit, %**** | 2.6 | 1.9 |

*this ratio includes the moisture in the wood
**sulfidity is expressed on an AA basis
***at 30 kappa number and relative to the kraft process
****at 20 kappa number and relative to the kraft process

We claim:

1. A process of cooking particulate lignocellulosic material in a cooking liquor to reduce kappa number and produce wood pulp, comprising:

forming a cooking composition comprising a particulate lignocellulosic material having a particle thickness of not more than 2 mm in a kraft cooking liquor having an effective content of polysulfide, heating the thus formed composition in a time of about 2 to about 10 minutes, to a cooking temperature of at least 150° C., and cooking the particulate lignocellulosic material in said cooling liquor at said cooking temperature of at least 150° C. to produce a wood pulp.

2. A process according to claim 1, wherein said polysulfide is in an amount effective to oxidize aldehyde groups in the wood polysaccharides of the particles thereby hindering carbohydrate degradation in the lignocellulosic material during cooking.

3. A process according to claim 2, wherein said lignocellulosic material comprises wood chips.

4. A process according to claim 2, wherein said lignocellulosic material comprises sawdust.

5. A process according to claim 1, wherein the content of polysulfide is about 1 to about 2%, by weight, expressed as elemental sulfur, based on the weight of lignocellulosic material.

6. A process according to claim 5, wherein said lignocellulosic material comprises wood chips.

7. A process according to claim 6, wherein said time is about 2 to about 5 minutes.

8. A process according to claim 5, wherein said lignocellulosic material comprises sawdust.

9. A process according to claim 8, wherein said time is about 2 to about 5 minutes.

10. A process according to claim 5, wherein said time is about 2 to about 5 minutes.

11. A process according to claim 10, wherein said cooking temperature is about 165° C. to 185° C.

12. A process according to claim 1, wherein said lignocellulosic material comprises sawdust.

13. A process according to claim 1, wherein said time is about 2 to about 5 minutes.

14. A process according to claim 13, wherein said cooking temperature is about 165° C. to 185° C.

15. A process according to claim 1, wherein said cooking temperature is about 165° C. to about 185° C.

16. A process according to claim 1, wherein said lignocellulosic material comprises wood chips.

17. In a wood particle digestion process in which wood particles are cooked in a kraft cooking liquor to reduce kappa and produce pulp, while oxidizing aldehyde groups in the wood polysaccharides of the wood particles, with polysulfide in the cooking liquor, the improvement wherein the wood particles have a thickness of up to 2 mm, the cooking liquor containing the wood particles is heated, in a time of about 2 to about 10 minutes to a cooking temperature of about 165° C. to about 185° C., and said wood particles are cooked in said cooking liquor at said cooking temperature of about 165° C. to about 185° C.

18. A process according to claim 17, wherein said wood particles comprise sawdust.

19. A process according to claim 17, wherein said wood particles comprise wood chips.

20. A process of claim 17, wherein the polysulfide is present in the cooking liquor in an amount of about 1 to about 2%, by weight, expressed as elemental sulfur, based on the weight of wood particles, and the cooking liquor containing the wood particles and polysulfide is heated to said cooking temperature in a time of about 2 to about 5 minutes, for the cooking.

* * * * *